United States Patent [19]

Willmore

[11] 4,159,454

[45] Jun. 26, 1979

[54] PLUG-IN FILTER NETWORK FOR SEPARATING A COMMUNICATION FREQUENCY INTO DISCRETE FREQUENCY CHANNELS

[75] Inventor: Robert R. Willmore, Millersville, Md.

[73] Assignee: The United States of America as represented by the Secretary of the Air Force, Washington, D.C.

[21] Appl. No.: 866,125

[22] Filed: Dec. 30, 1977

[51] Int. Cl.[2] ..... H01P 1/20

[52] U.S. Cl. ..... 333/20; 325/3; 333/1.1; 333/110; 333/202

[58] Field of Search ..... 333/1, 1.1, 2, 6, 28 R, 333/73 R, 73 W, 20; 328/140, 167; 325/3, 4; 179/15 R, 15 AD, 15 BD

[56] References Cited

U.S. PATENT DOCUMENTS 4,109,202 8/1978 Kudsia et al. ..... 333/1.1 X

*Primary Examiner*—Paul L. Gensler

*Attorney, Agent, or Firm*—Joseph E. Rusz; Henry S. Miller

[57] ABSTRACT

A filter network for separating a transmitted communication frequency into discrete channels. A separator, exemplified by a triplexer, includes a pluggable mid-range high Q bandpass filter and a diplexer of low Q bandpass filters. Circulators receive signals reflected from the high Q filter and pass them to the low Q filters. A combiner circuit takes the attenuated signal from the low Q filters and sends it through a circulator to a high Q plug in filter where the signal passes through a circulator where it is combined with the signal from the high Q filter of the separator as output.

2 Claims, 9 Drawing Figures

DESIRED CHARACTERISTICS

BANDPASS FILTER SEPARATOR

DIPLEXER CHARACTERISTICS

SEPARATOR OUTPUT

BAND REJECTION FILTER-COMBINER

ACTUAL CHARACTERISTICS

PLUG-IN FILTER NETWORK FOR SEPARATING A COMMUNICATION FREQUENCY INTO DISCRETE FREQUENCY CHANNELS

STATEMENT OF GOVERNMENT INTEREST

The invention described herein may be manufactured and used by or for the Government for governmental purposes without the payment of any royalty thereon.

BACKGROUND OF THE INVENTION

This invention relates generally to filter networks for communication systems and more particularly to a filter network for separating a communication frequency into discrete frequency channels.

In certain communications systems it is desirable to transmit a plurality of signals over a particular frequency band. Typically, these transmitters employ filter bank separators and combiners which serve to split the transmitters frequency band into smaller frequency segments referred to as channels. The frequency limits of each channel is chosen to meet the needs of the system, whether it be radio, radar, telemetry, etc.

The major problem with the existing channelization approach is that at times it is necessary to change the channel frequency relatively quickly as new needs arise for the system. Some systems, which may be mobile as well as stationary, may require modification in the field, which is ordinarily a long, laborius and expensive operation.

One solution to the problem has been the utilization of plug-in-filters. This approach permits one or more filters to be changed relatively easily without requiring the replacement of the entire separator and combiner filter banks. This method also has limitations which make it less than a completely desirable solution. For example, the plug-in-filter approach requires more circulators than needed to implement a fixed filter bank. As a result the volume required is greater, the cost higher and in some channels, the insertion loss greater. Further, in order to move merely a single cross-over point in a triplexer system without loss of continuous coverage, it is necessary to replace 4 of the 6 plug-in filters used to implement the triplexer. Hence, such a plug-in circuit would constitute only a slight improvement over the system which requires replacement of the entire separator and and combiner filter banks.

SUMMARY OF THE INVENTION

The invention relates to a simplified plug-in filter circuit for channelizing frequencies in a communications transmitter. Utilizing the reflective properties of filters, a single plug-in channel is permitted to control the cross-over points of a three channel combination triplexer separator and triplexer combiner assembly.

The invention is best exemplified when utilized in a conventional electronic counter measures system which detects signals from stations and retransmits that signal back to the sending station.

Signals are received in the ordinary course of such a system and passed to the input of the triplexer separator. The signals are passed through a circulator to the input of a high Q plug-in bandpass filter. This filter serves to form the passband characteristics of the second or center triplexer channel. Signals falling outside the filters pass band (including the first and third channel frequency ranges plus VSWR reflections) are reflected back through the circulator to a second circulator. The output of the second circulator is sent to a diplexer of low Q bandpass filters that serve to isolate the first and third channel frequency ranges. Since the separator provides channel crossings at 3 dB attenuation points, improvement is made to the combiner to provide a 10 to 20 dB attenuation desired in electronic countermeasures systems.

In the combiner, the diplexer (low Q band-pass filters) output is passed through a circulator to a high Q, plug-in band reject filter. Since the reject band of this filter is designated as wider than the passband of the separators' plug-in filter, that portion of the first and third channels passband near the cross-over regions (and any separator second channel reflected power) is reflected back through the circulator to the load. This results in triplexer filter characteristics having the desired attenuation at the filter cross-over frequencies.

A prime advantage and object of the invention is that a typical change made to the separator and combiner plug-in filters (second channel) is automatically reflected in the first and third channel characteristics, (i.e. a change in both cross-over points is achieved with the replacement of the plug-in filters.

It is another object of the invention to provide a new and improved plug-in filter that is made with less difficulty and lower cost than present state-of-the-art devices.

It is a further object of the invention to provide a new and improved plug-in filter that is quickly changed and easily maintained.

It is still another object of the invention to provide a new and improved plug-in-filter that is small in size and light in weight.

It is still a further object of the invention to provide a new and improved plug-in filter circuit that operates with a relatively low insertion loss.

It is another object of the invention to provide a plug-in filter circuit which is economical to produce and utlizes conventional, currently available components that lend themselves to standard mass productions manufacturing techniques.

These and other advantages, features and objects of the invention will become more apparent from the following description taken in connection with the illustrative embodiment in the accompanying drawings.

DESCRIPTION OF THE PREFERRED EMBODIMENT

Figure 1:
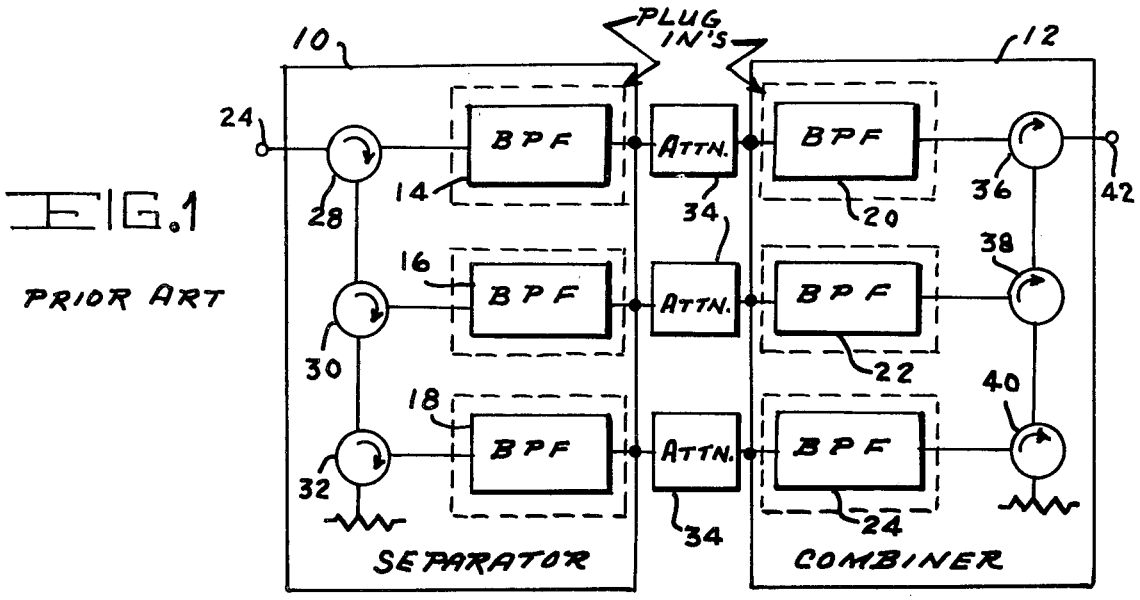
FIG. 1 PRIOR ART
FIG. 1 is a diagram of a prior art filter circuit.

FIG. 1 shows a prior art triplexer separator (10) and combiner (12) filter bank. High Q band pass filters 14–24 are plug-in and represent the most convenient arrangement currently available. The operation of this triplexer is based on the reflective properties of filters outside its pass-band. Signals received at the separator input 26 are passed through the first circulator to the first bandpass filter 14. If the signal frequency falls within the bandpass of the filter it is passed. If not, the signal is reflected back through the first circulator 28 and then through through the second circulator 30 to the second band pass filter 16 where the process is repeated with bandpass filter 18 and circulator 32. The signals are attenuated at attenuators 34 and passed to the combiner band pass filters 20–24 to circulators 36–40 and hence to output 42. The isolator-filter approach used in the triplexer can be extended to implement a quadruplexer, pentaplexer etc.

The plug-in filter approach requires more circulators than are needed to implement a fixed filter bank. In order to move a single notch or filter cross-over point without loss of continuous coverage it is necessary to replace 4 of the 6 plug-in filters used to implement a triplexer.

The invention makes use of the reflective properties of filters to permit a single plug-in channel to control the cross-over points of a three channel combination triplexer separator and triplexer combiner assembly.

Figure 2:
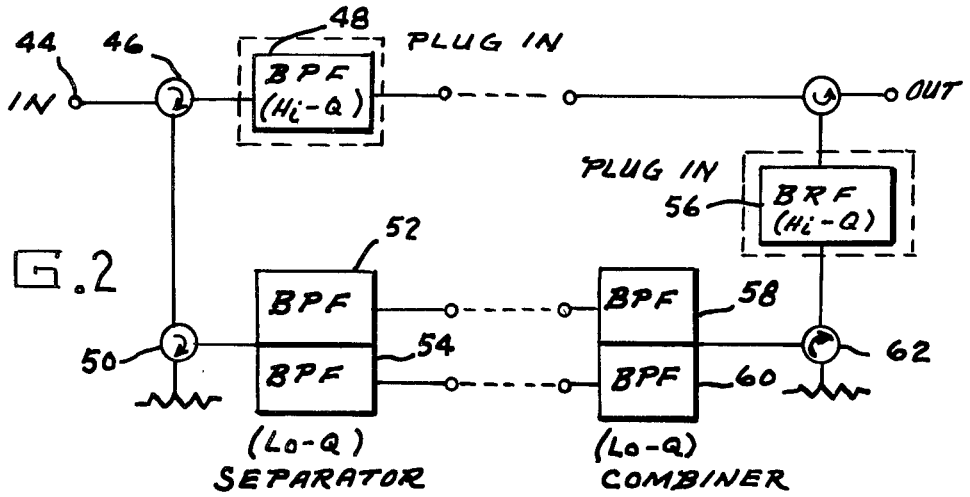
FIG. 2 is a diagram of the triplexer filter circuit of the invention.
Figure 3A:
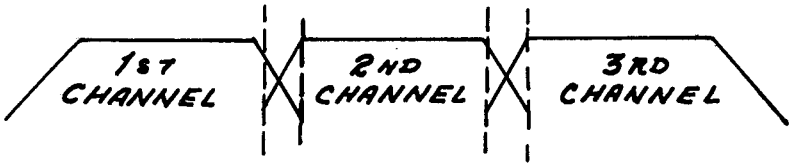
FIGS. 3*a* to 3*f* are a graphic representation of the filter characteristics of the invention.
Figure 3B:
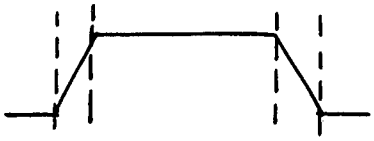
Figure 3C:
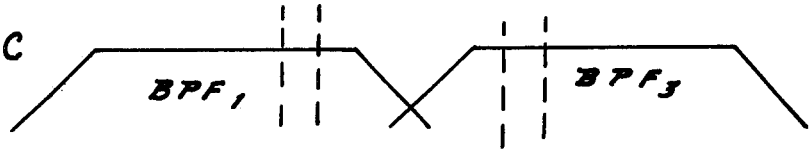
Figure 3D:
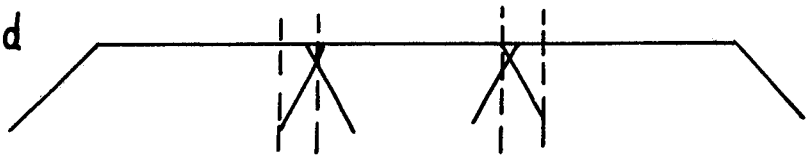
Figure 3E:
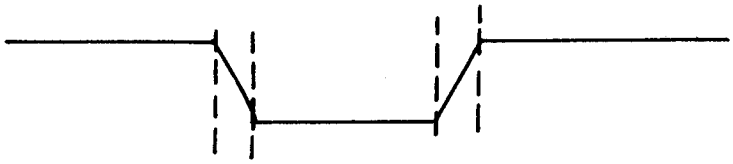
Figure 3F:
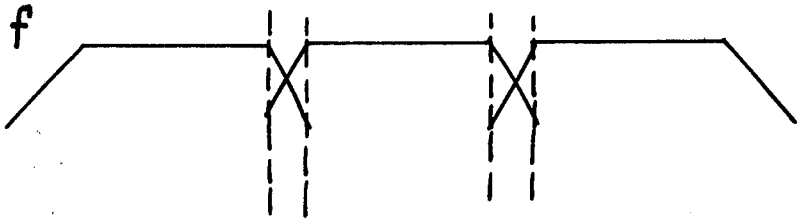

Referring now to FIGS. 1 and 2, the combination separator and combiner filter characteristics typically desired in a particular system are shown in FIG. *3a*. These characteristics include continuous filter coverage (except for notches) across the entire transmitter bandpass with extremely sharp filter roll-off in the filter cross-over region in order to minimize the loss in frequency coverage. The filter roll-off at band edges can typically be less than that in the cross-over region. However, it should be noted that present triplexer designs cannot easily exploit this fact in that sharp filter roll-off is required at band-edges in order to achieve sharp roll-off in the filter cross-over regions.

Signals received at the input of 44 of the triplexer separator are passed through a circulator 46 to the input of the high Q plug-in bandpass filter 48. This filter, the characteristic of which is shown in FIG. *3b*, serves to form the passband characteristics of the second or center triplexer channel. Signals falling outside the filters passband are reflected back through circulator 46 to circulator 50. The output of circulator 50 is sent to a diplexer of low Q bandpass filters 52,54 (see FIG. *3c*), that serves to isolate the first and third frequency ranges. The result, as shown in FIG. *3d*, is a triplexer separator with channel crossings at 3 db attenuation points. Although this may be acceptable for some applications in the electronic countermeasures, crossings on the order of 10 to 20 dB are desired.

This result is achieved by means of the high Q plug-in band reject filter 56 contained in the combiner. In the combiner diplexer output (bandpass filters 58, 60) is passed through circulator 62 to the band reject filter 56. Since, as shown in FIG. *3e*, the reject band of this filter is wider than the passband of the separators plug-in filter 48, that portion of the first and third channels passband near the cross-over regions (and any separator-second channel reflected power) is reflected back through the circulator to the load. This results, as shown in FIG. *3f*, in triplexer filter characteristics having the desired attenuation at the filter cross-over frequencies.

The second channel combiner input passes through circulator 62, is reflected from the band reject filter 56 and passes through a second circulator 64 to the output 68. A typical change made to the separator and combiner plug in filters is automatically reflected in the first and third channel characteristics.

Figure 4:
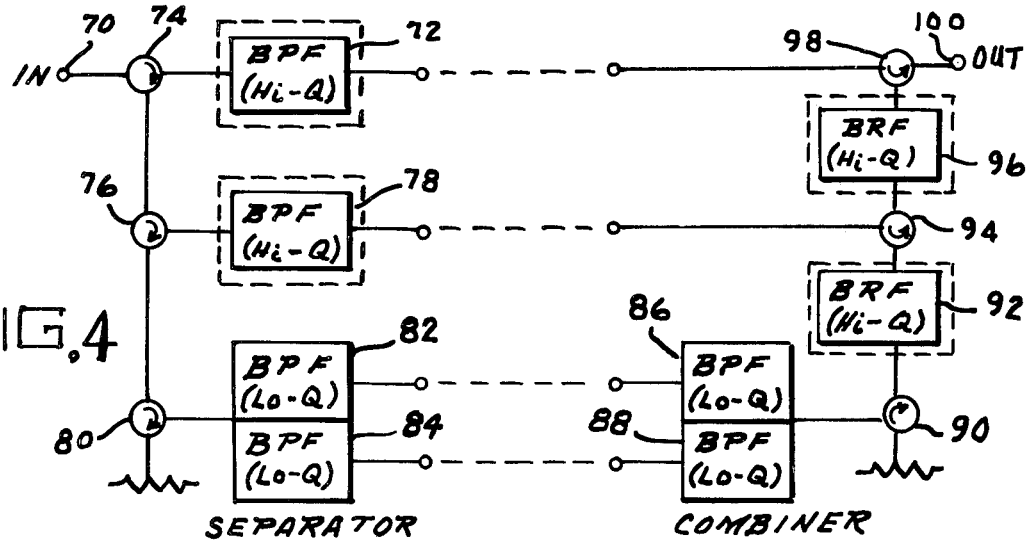
FIG. 4 is a diagram of the invention utilized with a quadruplexer.

Concerning FIG. 4, the invention is shown used in a quadruplexer circuit. Input 70 is passed to high Q plug-in bandpass filter 72. Reflected frequencies pass through circulators 74, 76 to a second plug-in high Q bandpass filter 78, reflected frequencies then go on to circulator 80 and the diplexer consisting of low Q bandpass filters 82,84. In the combiner signals from diplexer filters 86, 88 pass through circulator 90, high Q plug-in reject filter 92, circulator 94 and the second high Q plug-in rejecting filter 96. This signal passes through circulator 98 with the signal from bandpass filter 72 and produces an output 100.

Although the invention has been described with reference to particular embodiments, it will be understood to those skilled in the art that the invention is capable of a variety of alternative embodiments within the spirit and scope of the appended claims.

What is claimed is:

1. A simplified filter network for establishing discrete frequency channels in communication transmitting systems comprising: means for separating a frequency band into a plurality of selected frequencies including a signal input, a high Q bandpass filter connected to the input and first circulator means connected between the input and high Q bandpass filter, a second circulator means, a first diplexer circuit means comprising first and second low Q bandpass filters, said second circulator means connecting said first diplexer circuit to said first circulator means; and means for combining the plurality of frequencies in discrete form comprising a second diplexer circuit means coupled to said first diplexer circuit means and further comprising third and fourth low Q bandpass filters, a high Q band rejection filter, a third circulator means connecting the second diplexer circuit means and the band rejection filter and a fourth circulator means for combining the signal from the high Q bandpass filter and the high Q band rejection filter to provide a circuit signal output.

2. A simplified filter network according to claim 1 wherein said high Q bandpass filter and said high Q band rejection filters are formed of plug-in modules.

* * * * *